United States Patent [19]

Yasuoka

[11] Patent Number: 4,699,111

[45] Date of Patent: Oct. 13, 1987

[54] AIR-FUEL RATIO CONTROL METHOD FOR INTERNAL COMBUSTION ENGINES

[75] Inventor: Akimasa Yasuoka, Tokyo, Japan

[73] Assignee: Honda Giken Kogyo Kabushiki Kaisha, Toyko, Japan

[21] Appl. No.: 797,631

[22] Filed: Nov. 13, 1985

[30] Foreign Application Priority Data

Nov. 14, 1984 [JP] Japan ..... 59-238291

[51] Int. Cl.[4] ..... F02M 51/00

[52] U.S. Cl. ..... 123/489

[58] Field of Search ..... 123/440, 489

[56] References Cited

U.S. PATENT DOCUMENTS 4,107,921 8/1978 Iizuka ..... 123/489 X
4,127,088 11/1978 Ezoe ..... 123/440
4,383,515 5/1983 Higashiyama et al. ..... 123/489
4,418,672 12/1983 Müller et al. ..... 123/489 X

FOREIGN PATENT DOCUMENTS 0188743 11/1982 Japan .
0101242 6/1983 Japan .
0217749 12/1983 Japan .

*Primary Examiner*—Willis R. Wolfe, Jr.

*Attorney, Agent, or Firm*—Lyon & Lyon

[57] ABSTRACT

An air-fuel ratio control method for an internal combustion engine having a plurality of cylinders divided into at least two cylinder groups, wherein when each of the cylinder groups is in a first predetermined operating condition, the air-fuel ratio of a mixture being supplied to the each cylinder group is controlled in a feedback manner responsive to the output of corresponding one of at least two exhaust gas ingredient concentration sensors arranged in respective ones of at least two exhaust passage divided portions connected to respective cylinder groups, while when the each cylinder group is in a second predetermined operating condition, the air-fuel ratio of the mixture is controlled in an open loop mode corresponding to the second predetermined operating condition. When one cylinder group shifts from the first predetermined operating condition to the second predetermined operating condition, or vice versa, the air-fuel ratio for the one cylinder group is continually controlled in a control manner corresponding to one of the first and second predetermined operating conditions in which the engine was operating before the shift, until all the other cylinder groups shift to the other operating condition in which the on e cylinder group is operating after the shift.

3 Claims, 5 Drawing Figures

| |
|---|
| FIG. 2A |
| FIG. 2B |

AIR-FUEL RATIO CONTROL METHOD FOR INTERNAL COMBUSTION ENGINES

BACKGROUND OF THE INVENTION

This invention relates to a method of controlling the air-fuel ratio of an air-fuel mixture being supplied to an internal combustion engine, and more particularly to a method of this kind applied to an internal combustion engine having its cylinders divided into a plurality of cylinder groups, which is adapted to control the individual air-fuel ratios of mixtures being supplied to respective ones of the cylinder groups, independently of each other.

An air-fuel ratio feedback control method for an internal combustion engine has been proposed, e.g. by Japanese Provisional Patent Publication No. 57-188743, in which the concentration of a particular ingredient, e.g. oxygen, contained in exhaust gases emitted from the engine is detected by an oxygen concentration sensor (hereinafter referred to as "the $O_2$ sensor") arranged in the exhaust system of the engine, and when the engine is operating in a normal operating condition, the air-fuel ratio is controlled in closed loop or feedback mode in response to a signal indicative of the $O_2$ concentration from the $O_2$ sensor, to a predetermined value, e.g. a theoretical air/fuel ratio (this manner of controlling the air-fuel ratio is hereinafter called "the $O_2$ feedback control), to thereby reduce fuel consumption and improve emission characteristics of the engine.

Another method of controlling the air-fuel ratio has been proposed, e.g. by Japanese Provisional Patent Publication No. 58-217749, in which when the engine is operating in one of particular operating regions (e.g. a high load operating region, and a mixture-leaning region), the $O_2$ feedback control is interrupted, and the air-fuel ratio is controlled in open loop mode to one of predetermined values corresponding to the above one particular operating region of the engine, which is best suited for the one particular operating region.

A further air-fuel ratio feedback control method has been proposed, for instance, by Japanese Provisional Patent Publication No. 58-101242, for a multicylinder internal combustion engine such as a V-type engine, which has a plurality of (e.g. six) cylinders divided into a plurality of (e.g. two) groups each of which comprises three cylinders, for example, and is connected with respective one of a plurality of divided exhaust passage portions, wherein a plurality of $O_2$ sensors are arranged in respective ones of the exhaust passage portions, and the air-fuel ratios of mixtures being supplied to respective ones of the cylinder groups are controlled in a feedback manner responsive to the output values from corresponding ones of the $O_2$ sensors, independently of each other.

However, according to the last-mentioned proposed method, the determination as to whether the engine is operating in a condition wherein the $O_2$ feedback control should be effected or in a condition wherein the open loop mode control should be effected is made with respect to each of the cylinder groups independently of each other. This can result in determination that the cylinder groups are operating in different conditons from each other. In such a case, while the air-fuel ratio of a mixture or mixtures being supplied to one or some of the cylinder groups is controlled in the $O_2$ feedback mode to a value equal to the theoretical air-fuel ratio, the air-fuel ratio of the other mixture(s) being supplied to the other cylinder group(s) is controlled in open loop mode to a value or values richer or leaner than the theoretical air-fuel ratio, resulting in deterioration of the driveability of the engine. Particularly, when the engine is operating in a predetermined high load operating region wherein the air-fuel ratio should be controlled in open loop mode to achieve a richer air-fuel ratio, if part of the cylinder groups is supplied with a mixture of which the air-fuel ratio is controlled in the $O_2$ feedback mode to the theoretical air-fuel ratio, a required output torque of the engine cannot be obtained, thus deteriorating the driveability of the engine to a great extent.

SUMMARY OF THE INVENTION

It is the object of the invention to provide an air-fuel ratio control method for an internal combustion engine having its cylinders divided into a plurality of groups which are individually supplied with mixtures having their respective air-fuel ratios controlled independently of each other, which method is capable of avoiding that the air-fuel ratios become different from each other between the cylinder groups, when the engine operation shifts from the $O_2$ feedback control-effecting condition to an air-fuel ratio open loop control-effecting condition, or vice versa, to thereby prevent deterioration of the driveability of the engine. The present invention provides a method of controlling the air-fuel ratio of an air-fuel mixture being supplied to an internal combustion engine having a plurality of cylinders divided into at least two cylinder groups, an exhaust passage having at least two divided portions connected to respective ones of the at least two cylinder groups, and at least two exhaust gas ingredient concentration sensors arranged in respective ones of the at least two divided portions of the exhaust passage, wherein when each of the at least two cylinder groups is in a first predetermined operating condition, the air-fuel ratio of a mixture being supplied to the each cylinder group is controlled in a feedback control manner responsive to an output of corresponding one of the at least two exhaust gas ingredient concentration sensors, while when the each cylinder group is in a second predetermined operating condition, the air-fuel ratio of the mixture is controlled in an open loop control manner corresponding to the second predetermined operating condition.

The method according to the invention is characterized by comprising the following steps: (a) determining whether each of the at least two cylinder groups is in the first predetermined operating condition or in the second predetermined operating condition; (b) when one of the at least two cylinder groups shifts from the first predetermined operating condition to the second predetermined operating condition, or vice versa, continually effecting control of the air-fuel ratio of a mixture being supplied to the one cylinder group in one of said control manners corresponding to one of said first and second predetermined operating conditions in which the engine was operating before the shift, until all the cylinder groups other than the one cylinder group shift to the other of said first and second predetermined operating conditions in which the one cylinder group is operating after the shift.

Preferably, the second predetermined operating condition at least includes a predetermined high load operating region of the engine.

Preferably, the step (b) comprises continually effecting the control of the air-fuel ratio of the mixture being supplied to the one cylinder group in the one control manner corresponding to the one of the first and second predetermined operating conditions in which the engine was operating before the shift, until a predetermined period of time elapses from the time the all cylinder groups other than the one cylinder group have shifted to the other operating condition in which the one cylinder group is operating after the shift.

The above and other objects, features and advantages of the invention will be more apparent from the ensuing detailed description taken in conjunction with the accompanying drawings.

BRIEF DESCRIPTION OF THE DRAWINGS

FIGS. 2, 2A and 2B are flowchart showing a manner of calculating the value of an $O_2$ sensor output-dependent correction coefficient $KO_2$ according to the method of the invention.

DETAILED DESCRIPTION

The invention will now be described in detail with reference to the drawings.

Figure 1:
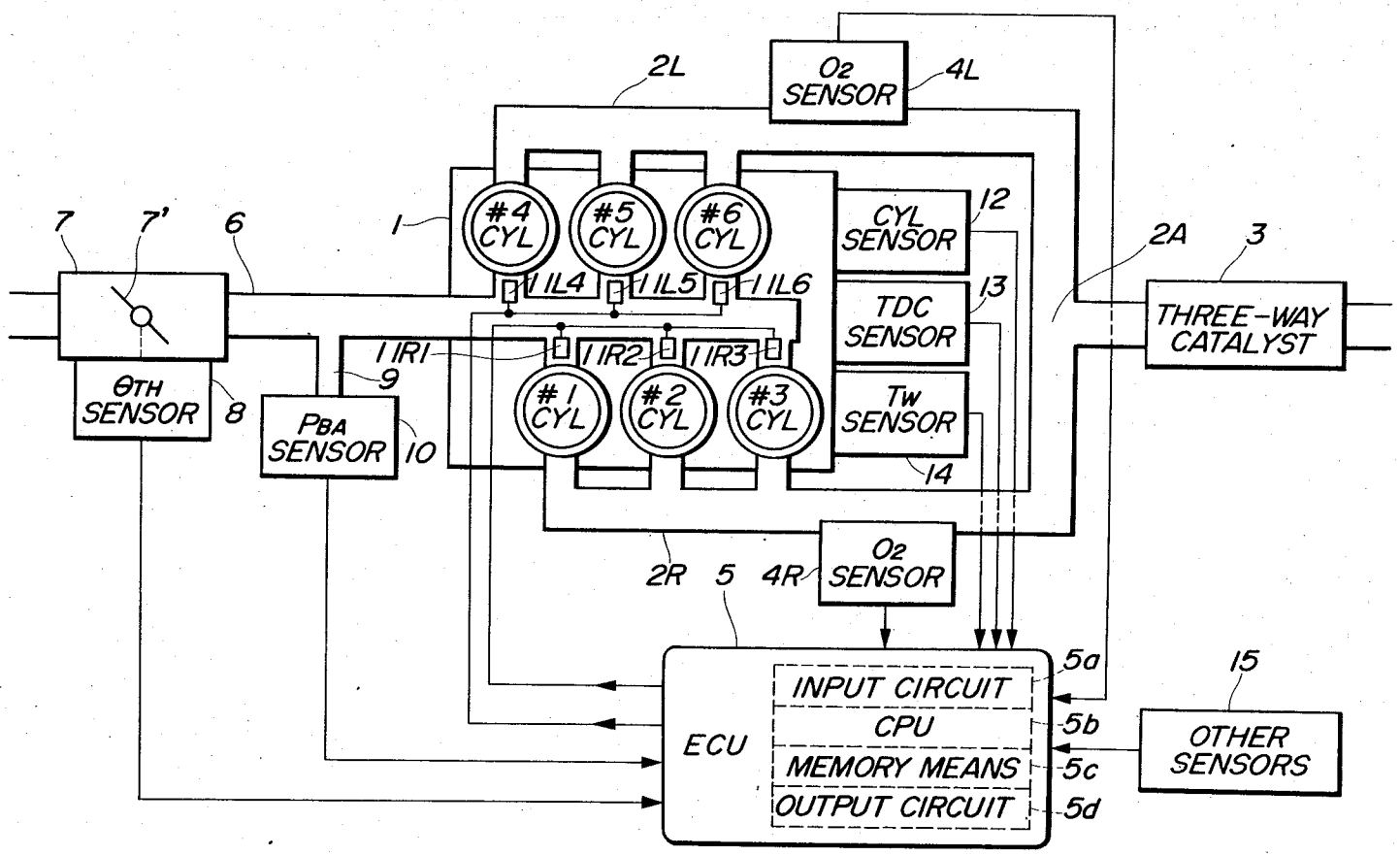
FIG. 1 is a block diagram illustrating the whole arrangement of an air-fuel ratio control system of an internal combustion engine, to which is applied the method according to the invention.

Referring first to FIG. 1, there is illustrated the whole arrangement of an air-fuel ratio control system of an internal combustion engine, to which the method of the invention is applied. Reference numeral 1 designates an internal combustion engine which may be a six cylinder V-type engine, for instance, and have cylinders #1 -#6. An exhaust passage divided portion 2R and an exhaust passage divided portion 2L are connected to the #1 #3 cylinders and the #4 -#6 cylinders, respectively, independently of each other. The exhaust passage divided portions 2R and 2L are joined at a junction 2A downstream of which is arranged a three-way catalyst 3 for purifying ingredients HC, CO, NOx, etc. contained in the exhaust gases. $O_2$ sensors 4R and 4L as exhaust gas ingredient concentration sensors are inserted in the exhaust passage divided portions 2R and 2L, respectively, at locations upstream of the junction 2A for detecting the concentration of oxygen contained in the exhaust gases in the respective exhaust passage divided portions 2R and 2L and supplying respective electrical signals indicative of detected oxygen concentration values to an electronic control unit (hereinafter called "the ECU") 5.

Connected to all the cylinders #1 -#6 is an intake passage 6 in which is arranged a throttle body 7 within which is mounted a throttle valve 7'. Connected to the throttle valve 7' is a throttle valve opening ($\theta$TH) sensor 8 for detecting its valve opening and converting same into an electrical signal which is supplied to the ECU 5. An absolute pressure (PBA) sensor 10 is arranged in communication through a conduit 9 with the interior of the intake passage 6 at a location downstream of the throttle valve 7' of the throttle body 7. The absolute pressure (PBA) sensor 10 is adapted to detect absolute pressure in the intake passage 6 and applies an electrical signal indicative of detected absolute pressure to the ECU 5.

Fuel injection valves 11R1–11R3, and 11L4–11L6 are arranged in the intake passage 6, which correspond in number to the number of the engine cylinders #1–#6 and are each arranged in an intake port, not shown, of a corresponding engine cylinder, in a manner such that the fuel injection valves 11R1–11R3 and the fuel injection valves 11L4–11L6 correspond to the engine cylinders #1–#3 and the engine cylinders #4–#6, respectively. These injection valves 11R1–11R3, and 11L4–11L6 are connected to a fuel pump, not shown, and also electrically connected to the ECU 5 independently of each other in a manner having their respective valve opening periods or fuel injection quantities controlled independently of each other by respective signals supplied from the ECU 5.

On the other hand, a cylinder-discriminating (CYL) sensor 12 and a crank angle position sensor 13 (hereinafter called "the TDC sensor") are arranged in facing relation to a camshaft, not shown, of the engine 1 or a crankshaft of same, not shown. The former 12 is adapted to generate one pulse at a particular crank angle of a particular engine cylinder, while the latter 13 is adapted to generate one pulse at each of particular crank angles of the engine each time the engine crankshaft rotates through 120 degrees, i.e. each pulse of a top-dead-center position (TDC) signal. The above pulses generated by the sensors 12, 13 are supplied to the ECU 5. An engine temperature (TW) sensor 14, which may be formed of a thermistor or the like, is mounted on the main body of the engine 1 in a manner embedded in the peripheral wall of an engine cylinder having its interior filled with cooling water, of which an electrical output signal indicative of detected engine cooling water temperature is supplied to the ECU 5.

Further connected to the ECU 5 are other sensors 15 such as a sensor for detecting atmospheric pressure, for supplying electrical signals indicative of detected values of other engine operating parameters such as atmospheric pressure to the ECU 5.

The ECU 5 comprises an input circuit **5*a* having functions of shaping waveforms of pulses of some input signals from the aforementioned sensors, shifting voltage levels of the other input signals, and converting analog values of the input signals into digital signals, etc., a central processing unit (hereinafter called "the CPU") 5*b*, memory means 5*c* for storing various control programs executed within the CPU 5*b* as well as various calculated data from the CPU 5*b*, and an output circuit 5*d* for supplying driving signals to the fuel injection valves 11**.

The CPU **5*b* operates in response to various engine operation parameter signals as stated above, to determine operating conditions in which the engine is operating, such as a predetermined air-fuel ratio feedback control-effecting condition, hereinafter explained, and to calculate the fuel injection period TOUT for which the fuel injection valves 11R1–11R3, and 11L4–11L6** should be opened, in accordance with the determined operating conditions of the engine and in synchronism with generation of pulses of the TDC signal, by the use of the following equation:

$$TOUT = Ti \times KO_2 \times K1 + K2 \quad , (1)$$

where Ti represents a basic value of the valve opening period or fuel injection period of the fuel injection valves 11R1–11R3, and 11L4–11L6, which may be determined as a function of intake pipe absolute pressure PBA and engine speed Ne and read from a table stored in the memory means **5*c* of the ECU 5. $KO_2$ represents an $O_2$ sensor output-dependent correction coefficient, the value of which is determined in response to values of the oxygen concentration from the $O_2$ sensors 4R, and 4L during engine operation in the feedback control-effecting condition, and calculated in a manner hereinafter explained with reference to FIG. 2**. K1 and K2 represent correction coefficients and variables having their values calculated by respective predetermined equations on the basis of the values of engine parameter signals from various sensors, so as to optimize operating characteristics of the engine such as fuel consumption and emission characteristics. The correction coefficient K1 includes a mixture-leaning coefficient KLS applicable at mixture-leaning operation, hereinafter referred to.

More specifically, the CPU **5*b* calculates a fuel injection period value TOUTR, and a fuel injection period value TOUTL for the fuel injection valves 11R1–11R3 corresponding to the cylinders #1–#3 (hereinafter called "the #1 cylinder group"), and the fuel injection valves 11L4–11L6 corresponding to the cylinder (hereinafter called "the #4** cylinder group"), respectively, by the use of the above equation (1), wherein an $O_2$ W sensor output-dependent correction coefficient value $KO_2R$, and an $O_2$ sensor output-dependent correction coefficient value $KO_2L$, are applied as the correction coefficient $KO_2$, for calculation of the fuel injection period values TOUTR, and TOUTL, respectively.

Then the CPU **5*b* supplies pulses of driving signals corresponding to the calculated fuel injection period TOUT to the fuel injection valves 11R1–11R3, and 11L4–11L6, through the output circuit 5*d*. More specifically, pulses of a driving signal corresponding to the calculated value TOUTR, and pulses of a driving signal corresponding to the calculated value TOUTL are supplied to the fuel injection valves 11R1–11R3 corresponding to the #1 cylinder group, and the fuel injection valves 11L4–11L6 corresponding to the #4** cylinder group, respectively.

The fuel injection valves 11R1–11R3 are each energized by each pulse of their driving singal to open for a period of time corresponding to the calculated valve opening period value TOUTR, and to inject fuel into a corresponding intake port, so as to supply an air-fuel mixture having a desired air-fuel ratio to a corresponding cylinder of the #1 cylinder group, while the fuel injection valves 11L4–11L6 are each energized by each pulse of their driving signal to open for a period of time corresponding to the calculated valve opening period value TOUTL, and inject fuel into a corresponding intake port, so as to supply an air-fuel mixture having a desired air-fuel ratio to a corresponding cylinder of the #4 cylinder group.

Figure 2:
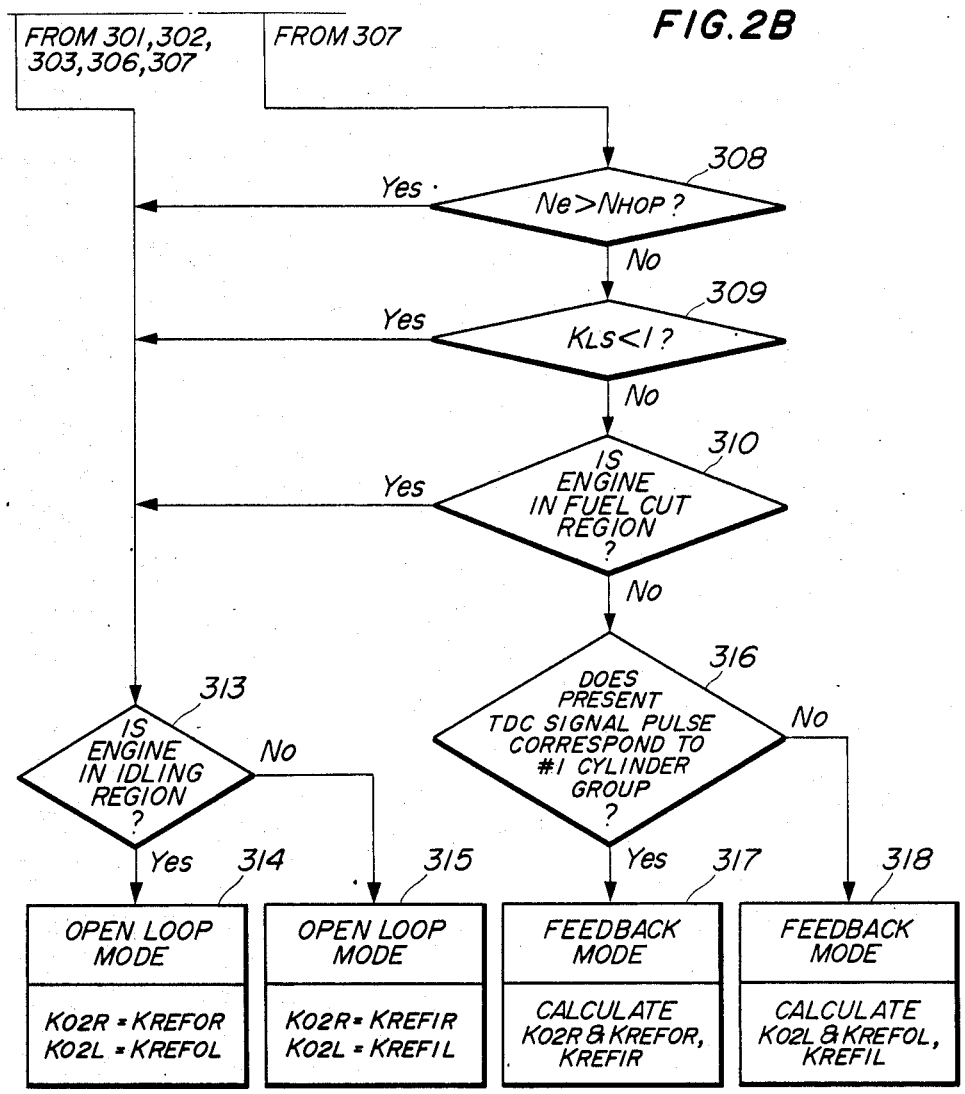
Figure 2A:
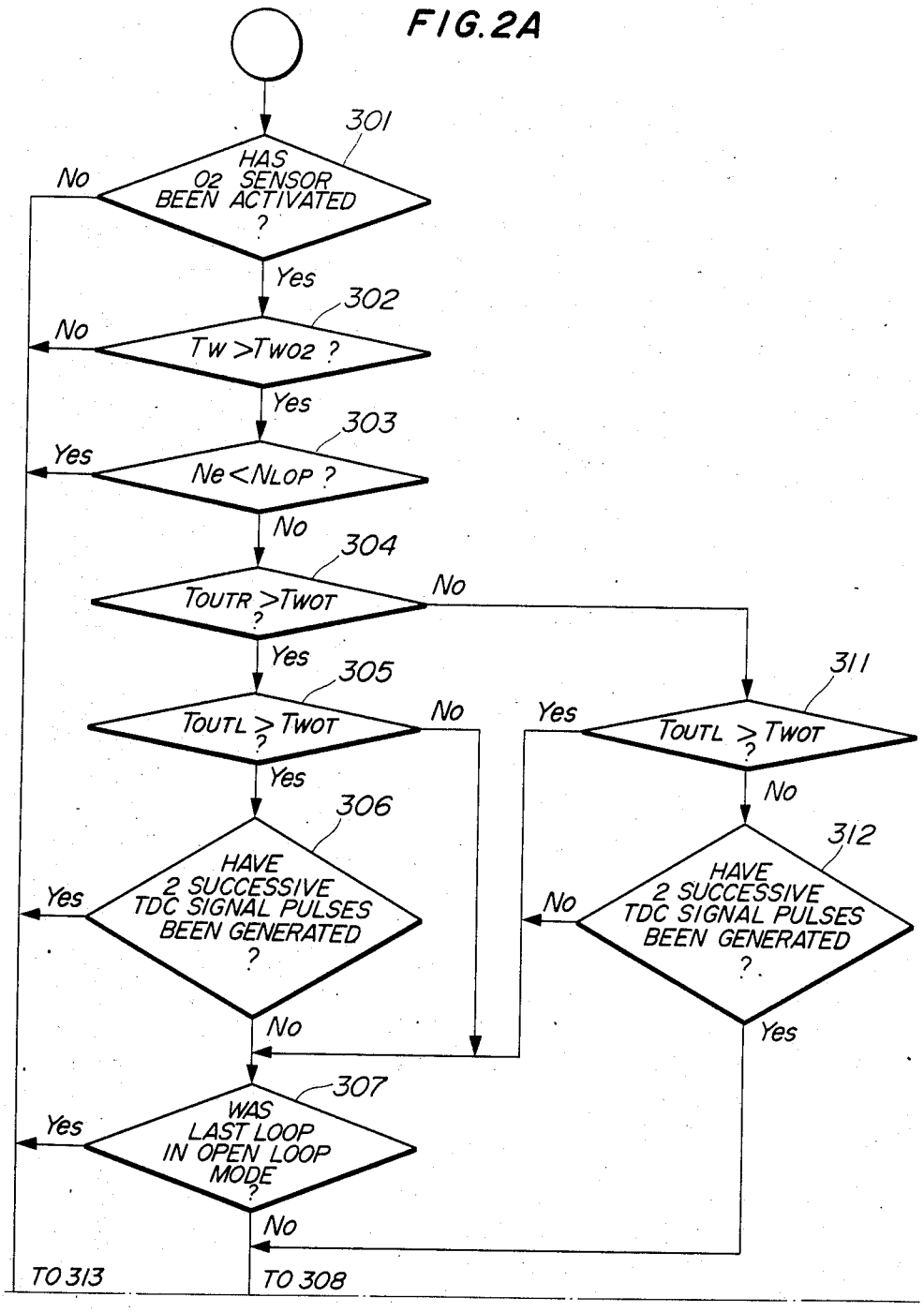

FIG. 2 is a flowchart showing a manner of calculating the value of the $O_2$ output-dependent correction coefficient $KO_2$ W according to the method of the invention, which calculation is executed within the CPU **5*b* appearing in FIG. 1** upon generation of each pulse of the TDC signal.

First, at the step 301, it is determined whether or not the $O_2$ sensors 4R and 4L have become activated. This determination may be made in accordance with a known method of utilizing the internal resistance of the $O_2$ sensor, wherein electric current is supplied at a predetermined rate to the $O_2$ W sensor, and it is determined that the $O_2$ sensor has become activated when the output voltage of the same sensor drops below a reference voltage. If the answer to the question of the step 301 is yes, i.e. if the $O_2$ sensors 4R and 4L have become activated, the program proceeds to the step 302, while if the answer to the question of the step 301 is no, i.e. if the $O_2$ W sensors 4R and 4L have not completed activation, the program proceeds to the step 313, hereinafter explained in detail, wherein determination is made as to whether or not the engine is in an open loop control-effecting idling region.

At the step 302, a determination is made as to whether or not the engine cooling water temperature TW detected by the TW sensor 14 (FIG. 1) is higher than a predetermined value $TWO_2$, e.g. 70° C. If the answer is yes, i.e. if the engine cooling water temperature TW is highter than the predetermined value $TWO_2$, it is judged that the warming-up of the engine 1 has completed, and then the program proceeds to the step 303, while if the answer is no, the step 313, hereinafter explained, is executed.

At the step 303, it is determined whether or not the engine is operating in a predetermined low engine speed region (indicated by the symbol I in FIG. 3) wherein the air-fuel ratio should be controlled in open loop mode, i.e. whether or not the engine speed Ne is lower than a predetermined value NLOP (e.g. 600 rpm). If the answer is yes, i.e. if the engine speed Ne is lower than the predetermined value NLOP, the program proceeds to the step 313, hereinafter explained, while if the answer is no, the step 304 is executed.

At the step 304, it is determined whether or not a value of the fuel injection period value TOUTR for the fuel injection valves 11R1–11R3 corresponding to the #1 cylinder group, obtained in the last loop, is larger than a predetermined value TWOT (e.g. 14.0 ms). This determination is made to determine whether or not the #1 cylinder group is operating in a predetermined high load operating region (wide-open-throttle region) indicated by the symbol II in FIG. 2 wherein open loop mode control of the air-fuel ratio should be effected. The predetermined value TWOT is set at a value corresponding to a lower limit value of the fuel injection period TOUT which is assumed during enigne operation in the predetermined high load operating region I. If the answer at the step 304 is yes, i.e. if the relationship of TOUTR > TWOT stands, the program proceeds to the step 305 wherein it is determined whether or not a value of the fuel injection period value TOUTL for the fuel injection valves 11L4–11L6 corresponding to the #2 cylinder group, obtained in the last loop, is larger than the predetermined value TWOT. If the answer at the step 305 is yes, i.e. if the relationhsip of TOUTL 22 TWOT stands, it is judged that the fuel injection period values TOUTR and TOUTL are both larger than the predetermined value TWOT, and accordingly, both the #1 cylinder group and the #4 cylinder group are in the high load operating region I, and then the program proceeds to the step 306, whereas if the answer to the step 305 is no, the step 307, hereinafter explained, is executed.

At the step 306, it is determined whether or not both the #1 cylinder group and the #4 cylinder group have continually been in the high load operating region over generation of two successive TDC signal pulses. The determination at the step 306 is made in order to avoid making wrong judgement at the steps 304 and 305 due to electrical noise or the like. Therefore, if the answer at the step 306 is no, the program proceeds to the step 307, hereinafter explained, while if the answer at the step 306 is yes, it is positively judged that the engine is operating in the high load operating region I, and the program proceeds to the step 313, hereinafter explained.

On the other hand, if the answer to the question of the step 304 is no, i.e. if the relationship of TOUTR 22 TWOT does not stand, then, the program proceeds to the step 311 to determine, similarly to the step 305, whether or not the the relationship of TOUTL>TWOT is satisfied. If the answer to the question of the step 311 is yes, that is, if it is determined that the #1 cylinder group and the #4 cylinder group are operating in different operating regions from each other, the program proceeds to the step 307. On the other hand, if the answer to the question of the step 311 is no, it is judged that neither the #1 cylinder group nor the #4 cylinder group is in the high load operating region, and then the program proceeds to the step 312.

At the step 312, it is determined whether or not both of the #1 cylinder group and #4 cylinder group have continually been in a region other than the high load operating region over generation of two TDC signal pulses. If the answer to the question of the step 312 is yes, the program proceeds to the step 308, hereinafter explained, while the answer to the question of the step 312 is no, then, the step 307 is executed.

At the step 307, it is determined whether or not the control was effected in open loop mode in the last loop, i.e. whether or not the engine was in open loop control-effecting condition (indicated by one of the regions which are not hatched in FIG. 3), in the last loop. If the answer at the step 307 is yes, the program proceeds to the step 313, while if the answer at the step 307 is no, i.e. if the last loop was in feedback mode, the program proceeds to the step 308.

In this manner, if it is judged from the determinations at the steps 304 and 305, or from the determinations at the steps 304 and 311 that the two cylinder groups are operating in different operating regions from each other, the program proceeds to the step 307 to continue control of the air-fuel ratio in the same control mode (either open loop mode or feedback mode) as in the last loop, until the two cylinder groups are brought into the same operating condition, to thereby avoid supplying the two cylinder groups with mixtures having different air-fuel ratios.

At the step 308, it is determined whether or not the engine is operating in a predetermined high engine speed region (indicated by the symbol III in FIG. 3), wherein open loop control should be effected, that is, whether or not the engine speed Ne is higher than a predetermined value NHOP (e.g. 3000 rpm). If the answer is yes, the program proceeds to the step 313, while if the answer is no, it is determined, at the step 309, whether or not the value of the mixture-leaning correction coefficient KLS is smaller than 1 (i.e. KLS<1), in other words, whether or not the engine is operating in a mixture-leaning region (indicated by the symbol IV in FIG. 3).

Figure 3:
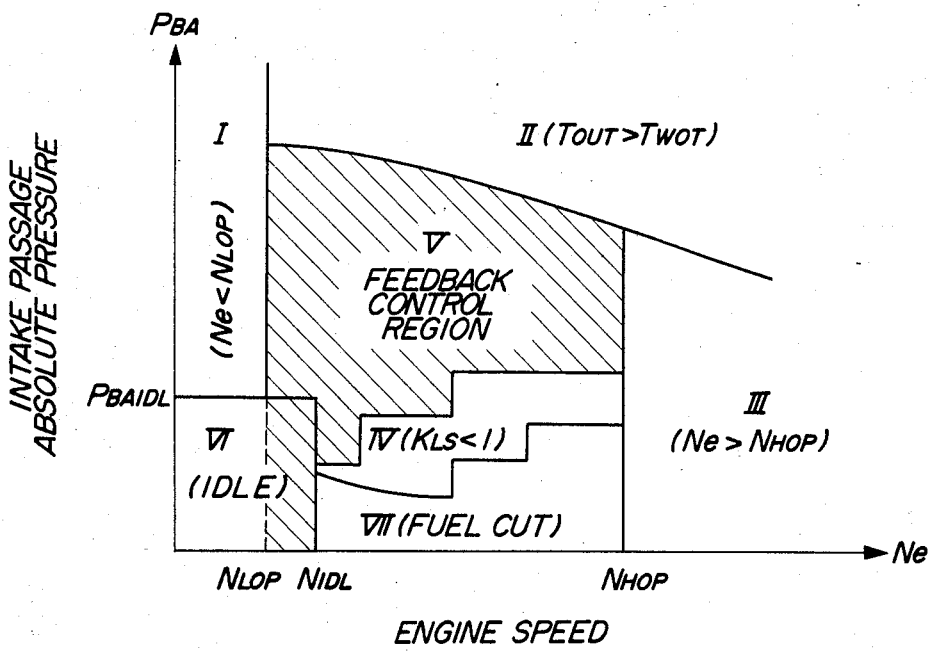
FIG. 3 is a graph showing various operating regions of the engine.

If the answer at the step 309 is yes, the program proceeds to the step 313, while if the answer at the step 309 is no, the step 310 is executed to determine whether or not the engine is operating in a fuel-cut effecting region (indicated by the symbol VII in FIG. 3). At this step 310, it is determined whether or not the throttle valve opening $\theta$TH shows a substantially fully closed position, when the engine speed Ne is lower than a predetermined value NFC (e.g. 2000 rpm), while it is determined whether or not the intake pipe absolute pressure PBA is lower than a predetermined value PBAFCj which is set to larger values as the engine speed Ne increases, when the engine speed Ne is higher than the predetermined value NFC. If the determination at the step 310 provides an affirmative answer (yes), i.e. when the engine is operating in the fuel-cut effecting region, the program proceeds to the step 313, while if the answer is no, it is judged that the engine is operating in the $O_2$ feedback control-effecting condition (indicated as the hatched regions in FIG. 3, i.e. the feedback control region V or part of the idling region VI) wherein the air-fuel ratio of the mixture should be controlled in response to the output of the $O_2$ sensors 4R and 4L, and then the program proceeds to the step 316, hereinafter explained.

At the step 313, it is determined whether or not the engine is operating in the idling region (indicated by part of the idling region VI which is not hatched in FIG. 3) wherein the air-fuel ratio should be controlled in open loop control. The determination as to whether or not the engine is operating in the open loop control-effecting idling region is made, e.g. by determining whether or not the engine rotational speed Ne is lower than the predetermined value NLOP (e.g. 600 rpm), and at the same time, the intake pipe absolute pressure PBA is lower than a value PBAIDL (e.g. 350 mmHg). If these determinations both provide affirmative answers, it is decided that the engine is operating in the idling region VI.

If the answer to the question at the step 313 is yes, i.e. if the engine is in the idling region wherein open loop control of the air-fuel ratio should be effected, the program proceeds to the step 314 to set the value of the $O_2$ W sensor output-dependent correction coefficient $KO_2$ to a first mean value KREF0 calculated from $KO_2$ values which have been applied during preceding feedback control effected while the engine was operating in the feedback control-effecting idling region. To be specific, the $O_2$ sensor output-dependent correction coefficient $KO_2L$ for calculation of the fuel injection period TOUTR, and the $O_2$ sensor output-dependent correction coefficient $KO_2L$ for calculation of the fuel injection period TOUTL, are set to a first mean value KREF0R, and a first mean value KREF0L, respectively. On the other hand, if the answer to the step 313 is no, i.e. if the engine is in an open loop control-effecting region other than the open loop control-effecting idling region, the program proceeds to the step 315 wherein the value of the correction coefficient $KO_2$ is set to a second mean value KREFl calculated from $KO_2$ values which have been applied during preceding feedback control effected while the engine was operating in feedback control-effecting condition other than the feedback control-effecting idling region. To be specific, the $O_2$ sensor output-dependent correction coefficient $KO_2L$ for calculation of the fuel injection period TOUTR, and the $O_2$ sensor output-dependent correction coefficient $KO_2L$ for calculation of the fuel injection period TOUTL, are set to a second mean value KREFlR, and a second mean value KREFlL, respectively. By virtue of thus setting the $O_2$ output-dependent correction coefficient values $KO_2R$ and $KO_2L$ (both as the correction coefficient $KO_2$), either to the first mean values KREF0R and KREF0L (both as the first mean value KREF0), respectively, at the step 314, or to the second mean values KREFlR and KREFlL (both as the second mean value KREF1), respectively, at the step 315, it is possible to control the air-fuel ratio of a mixture being supplied to the engine to a closest possible value to a required air-fuel ratio corresponding to the open loop control-effecting particular operating region in which the engine is operating, and also it can be prevented that the air-fuel ratio deviates from a required air-fuel ratio due to variations in the performance of various engine operating parameter sensors and a system for controlling or driving the fuel injection device, etc., which are caused by machining tolerances or the like and/or due to aging changes in the performance of the sensors and the system, to thus ensure desired stable operation as well as driveability of the engine.

At the step 316, it is determined whether or not a present pulse of the TDC signal corresponds to a cylinder in the #1 cylinder group. If the answer at the step 316 is yes, the program proceeds to the step 317 wherein the value of the $O_2$ sensor output-dependent correction coefficient $KO_2R$ is calculated in response to the output value of the $O_2$ sensor 4R corresponding to the #1 cylinder group, to apply the calculated $KO_2R$ value as the correction coefficient $KO_2$ value to the $O_2$ feedback control of the air-fuel ratio of a mixture being supplied to the #1 cylinder group, and also calculated are the first mean value KREF0R, and the second mean value KREFIR which are applicable at the aforementioned steps 314, and 315, respectively. On the other hand, if the answer at the step 316 is no, i.e. if the present pulse of the TDC signal corresponds to a cylinder in the #4 cylinder group, the program proceeds to the step 318 wherein the value of the $O_2$ sensor output-dependent correction coefficient $KO_2L$ is calculated in response to the output value of the $O_2$ sensor 4L corresponding to the #4 cylinder group, to apply the calculated $KO_2L$ value as the correction coefficient $KO_2$ value to the $O_2$ feedback control of the air-fuel ratio of a mixture being supplied to the #4 cylinder group, and also, the first mean value KREF0L, and the second mean value KREF1L are calculated which are applicable at the aforementioned steps 314, and 315, respectively.

and 315, and the values $KO_2R$ and $KO_2L$ set at the steps 317 and 318 are selectively applied as the correction coefficient $KO_2$ value to the equation (1), to calculate the fuel injection period values TOUTR and TOUTL.

Incidentally, although in the foregoing embodiment, the determination as to whether or not each of the #1 cylinder group and the #4 cylinder group is in the high load operating region is made at the steps 304, 305, 311, 306, and 312, this is not limitative, but similar determination may be made with respect to any open loop control-effecting particular operating region other than the high load operating region.

What is claimed is:

1. A method of controlling the air-fuel ratio of an air-fuel mixture being supplied to an internal combustion engine having a plurality of cylinders divided into at least two cylinder groups, an exhaust passage having at least two divided portions connected to respective ones of said at least two cylinder groups, and at least two exhaust gas ingredient concentration sensors arranged in respsective ones of said at least two divided portions of said exhaust passage, wherein when each of said at least two cylinder groups is in a first predetermined operating condition, the air-fuel ratio of a mixture being supplied to said each cylinder group is controlled in a feedback control manner responsive to an output of corresponding one of said at least two exhaust gas ingredient concentration sensors, while when said each cylinder group is in a second predetermined operating condition, the air-fuel ratio of the mixture is controlled in an open loop control manner corresponding to said second predetermined operating condition, the method comprising the steps of: (a) determining whether each of said at least two cylinder groups is in said first predetermined operating condition or in said second predetermined operating condition, said determination being made with respect to each one of said at least two cylinder groups independently of the other cylinder group; (b) when one of said at least two cylinder, groups shifts from said first predetermined operating condition to said second predetermined operating condition, or vice versa, continually effecting control of the air-fuel ratio of a mixture being supplied to said one cylinder group in one of said control manners corresponding to one of said first and second predetermined operating conditions in which said engine was operating before said shift, until all the cylinder groups other than said one cyliner group shift to the other of said first and second predetermined operating conditions in which said one cylinder group is operating after said shift.

2. A method as claimed in claim 1, wherein said second predetermined operating condition at least includes a predetermined high load operating region of said engine.

3. A method as claimed in claim 1 or claim 2, wherein said step (b) comprises continually effecting said control of the air-fuel ratio of said mixture being supplied to said one cylinder group in said one control manner corresponding to said one of said first and second predetermined operating conditions in which said engine was operating before said shift, until a predetermined period of time elapses from the time the all cylinder groups other than said one cylinder group have shifted to said the other operating condition in which said one cylinder group is operating after said shift.

* * * * *